US006653840B2

(12) United States Patent
Yorita et al.

(10) Patent No.: US 6,653,840 B2
(45) Date of Patent: Nov. 25, 2003

(54) ION CURRENT DETECTING DEVICE FOR INTERNAL COMBUSTION ENGINE

(75) Inventors: Hiroshi Yorita, Kariya (JP); Masatoshi Ikeda, Hazu-gun (JP); Makoto Toriyama, Chiryu (JP); Tohru Yoshinaga, Okazaki (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 54 days.

(21) Appl. No.: 10/115,022

(22) Filed: Apr. 4, 2002

(65) Prior Publication Data

US 2002/0145429 A1 Oct. 10, 2002

(30) Foreign Application Priority Data

Apr. 5, 2001 (JP) ..... 2001-107101
Jan. 23, 2002 (JP) ..... 2002-014741

(51) Int. Cl.[7] ..... F02P 17/00
(52) U.S. Cl. ..... 324/380; 324/392
(58) Field of Search ..... 73/116, 118.01; 123/425, 606; 324/380, 391, 392, 399, 459

(56) References Cited

U.S. PATENT DOCUMENTS 6,104,195 A 8/2000 Yoshinaga et al.
6,550,463 B1 * 4/2003 Schmolla ..... 123/606
6,557,537 B2 * 5/2003 Ikeda et al. ..... 123/606
2002/0050823 A1 * 5/2002 Puettmann et al. ..... 324/388
2002/0144544 A1 * 10/2002 Kesler ..... 73/118.1
2003/0101797 A1 * 6/2003 Nishimoto et al. ..... 73/35.01

* cited by examiner

*Primary Examiner*—N. Le
*Assistant Examiner*—Walter Benson
(74) *Attorney, Agent, or Firm*—Nixon & Vanderhye P.C.

(57) ABSTRACT

In an engine ignition unit, a transistor and a current detecting resistor are connected to primary and secondary windings of an ignition coil, respectively. The current detecting resistor is used for detecting a current flowing between the opposing electrodes of spark plug. At an ignition by the spark plug, high-frequency square wave signals are generated by an oscillator after an ignition signal is cut off. The square wave signals turn on and off the transistor. By this operation, a battery voltage is intermittently applied to the primary winding and an ion current is measured. A frequency of the square wave signals is set close to a resonant frequency of an ion current path including the spark plug, the secondary winding of the ignition coil and the current detecting resistor.

11 Claims, 5 Drawing Sheets

ION CURRENT DETECTING DEVICE FOR INTERNAL COMBUSTION ENGINE

CROSS REFERENCE TO RELATED APPLICATION

This application is based on and incorporates herein by reference Japanese Patent Applications No. 2001-107101 filed on Apr. 5, 2001 and No. 2002-14741 filed on Jan. 23, 2002.

FIELD OF THE INVENTION

The present invention relates to an ion current detecting device for an internal combustion engine.

BACKGROUND OF THE INVENTION

Combustion conditions in an internal combustion engine continuously vary depending on driving conditions of a vehicle. To maintain good combustion conditions, abnormal combustion conditions, such as a misfire, are detected by measuring an ion current which is generated during combustion. Based on results of the abnormal combustion detection, ignition timing of spark plug and air-fuel ratio of air-fuel mixture are controlled. A combustion condition detecting device is proposed in U.S. Pat. No. 6,104,195 (JP-A-9-25867). In this device, an AC voltage is applied between opposing electrodes of an spark plug immediately after ignition. Then, a current flowing between the electrodes is measured. A capacitive current component generated by the AC voltage is eliminated from the detected current. Therefore, only a combustion ion current component can be extracted.

However, the output level of the ion current is generally low. Especially in a lean-burn engine and a stratified charge engine, the output level of the ion current is far lower. As a result, determining of abnormal combustion conditions, such as a misfire or a knock, by the ion current is difficult. Therefore, the level of the ion current needs to be raised in order to improve an accuracy in the ion current detection.

SUMMARY OF THE INVENTION

The present invention therefore has an objective to provide an ion current detecting device for an internal combustion engine enabling more accurate ion current detection in order to properly determine combustion conditions.

An ion current detecting device for an internal combustion engine of the present invention includes an ignition coil, a pair of opposing electrodes, an AC voltage applying device and a current detecting device. The ignition coil has primary and secondary windings. The opposing electrodes are connected to the secondary winding of the ignition coil installed in the combustion chamber of the internal combustion engine. The AC voltage applying device applies an AC voltage between the opposing electrodes. The current detecting device detects a current flowing between the opposing electrodes.

In this device, a current flows between the opposing electrodes at the same frequency as the AC voltage during combustion when the AC voltage is applied between the electrodes. The current is detected by the current detecting device. More particularly, combustion ions are generated in the combustion chamber immediately after the combustion. The current caused by the combustion ions (ion current) is detected.

Moreover, the frequency of the AC voltage applied is set close to a resonant frequency of the ion current path on the secondary side of the ignition coil. This causes a lager amount of ion current to flow and raise the level of the ion current. As a result, the accuracy in the ion current detection can be improved and the combustion conditions can be properly determined.

BRIEF DESCRIPTION OF THE DRAWINGS

The above and other objectives, features and advantages of the present invention will become more apparent from the following detailed description made with reference to the accompanying drawings. In the drawings.

DETAILED DESCRIPTION OF THE PREFERRED EMBODIMENT

The preferred embodiments of the present invention will be explained with reference to the accompanying drawings.

[First Embodiment]

Figure 1:
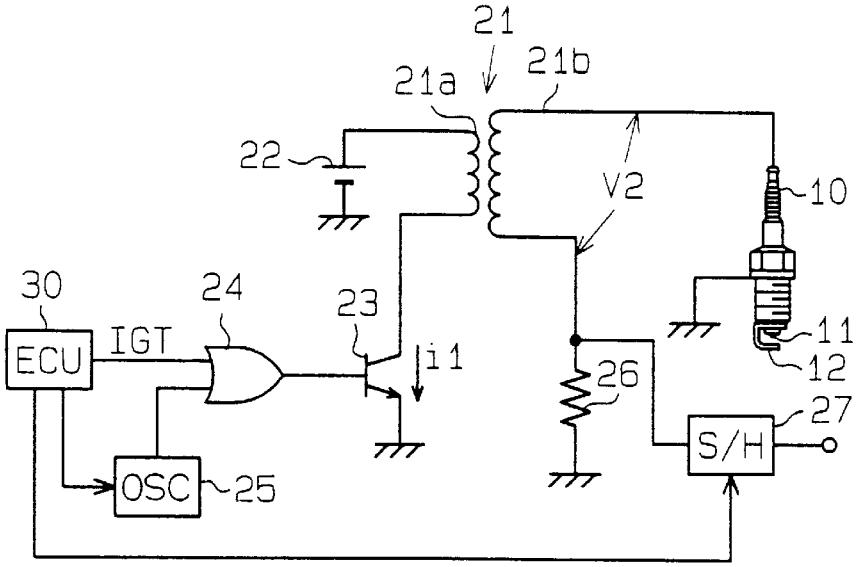
FIG. 1 is a schematic diagram showing an ion current detecting device for an internal combustion engine according to the first embodiment of the present invention.

Referring to FIG. 1, a spark plug 10 is placed in a combustion chamber of an internal combustion engine. The spark plug 10 has opposing electrodes 11 and 12. The electrode (center electrode) 11 is connected to the secondary winding 21*b* of an ignition coil 21. The electrode (ground electrode) 12 is grounded.

Ends of the primary winding 21*a* of the ignition coil 21 are connected to an onboard battery 22 and the collector of a transistor 23, respectively. The transistor 23 is used as a switching device. An ignition signal IGT is inputted to the base of the transistor 23 from an ECU 3 via an OR gate circuit 24. During the period when the ignition signal IGT is high (H), the transistor 23 turns on.

The input terminal of the OR gate circuit 24 is connected to an oscillator 25, which is an AC voltage applying device. The oscillator 25 generates square wave (pulse) signals with a predetermined frequency. The square wave signals are inputted to the base of the transistor 23 via the OR gate circuit 24.

A current detecting resistor 26 is connected to the secondary winding 21*b* of the ignition coil 21. It detects a current flowing between the opposing electrodes 11 and 12. The result of the current detection is inputted to a sample-hold (S/H) circuit 27 in the form of voltage. The sample-hold circuit 27 holds and outputs the result in predetermined timing directed by the ECU 30.

Figure 2:
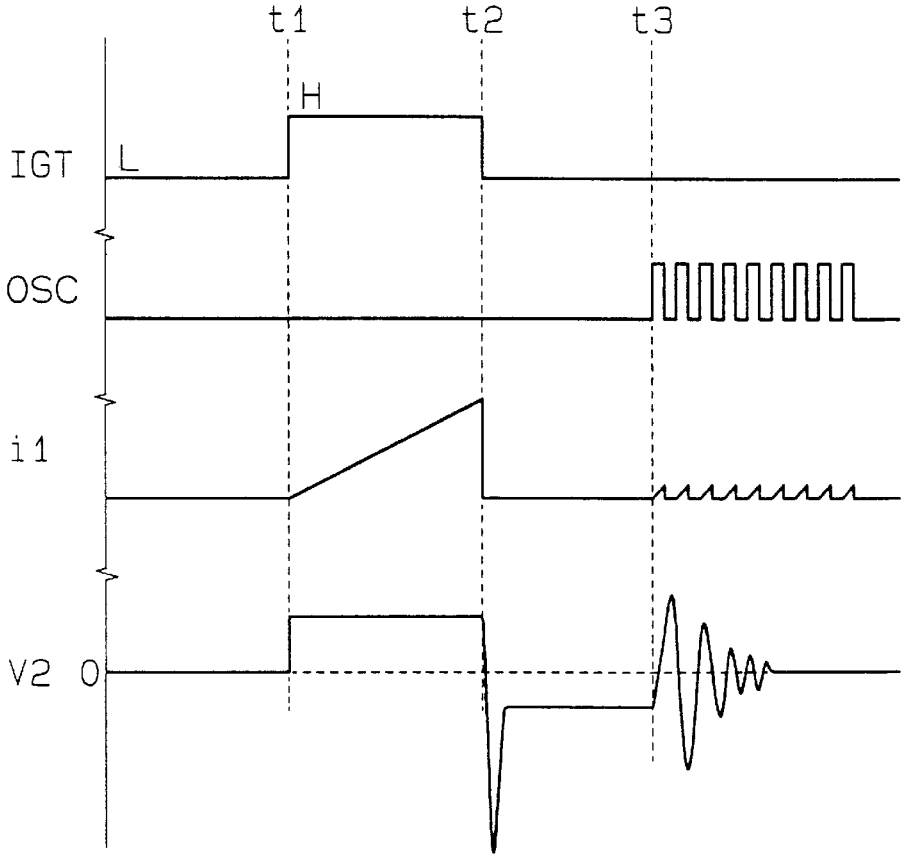
FIG. 2 is a time chart regarding an ignition operation in the first embodiment.

Referring to the time chart in FIG. 2, an ignition signal IGT, such as a 2 ms H-level signal, is outputted from the ECU 30 at the time t1. This turns on the transistor 23 and a primary current i1 flows as shown in FIG. 2. An energy for ignition is charged in the ignition coil 21. After the level of the ignition signal IGT shifts from the H-level to a low-level (L) at time t2, a secondary side voltage V2 is generated by electromagnetic induction. The voltage V2 is a high voltage and applied between the opposing electrodes 11 and 12. This causes a spark discharge between the opposing electrodes 11 and 12. The spark ignites fuel-air mixture sucked into the combustion chamber for combustion.

After the ignition, the discharge continues for a while (the duration between t2 and t3). At time t3, high-frequency square wave signals OSC are outputted from the oscillator 25. The square wave signals turn on and off the transistor 23 repeatedly. At this time, a battery voltage is intermittently applied to the primary winding 21*a*. By applying the voltage in such a manner as if it is an AC voltage, the ion current flowing between the opposing electrodes 11 and 12 is measured. Immediately after time t3 (end of the discharge), the secondary side voltage V2 oscillates as shown in FIG. 2 due to residual magnetism in the ignition coil 21.

In this embodiment, the frequency of the square wave signals produced by the oscillator 25 is set close to the resonant frequency f0 of the ion current path. The ion current path includes the spark plug 10, secondary winding 21 of the ignition coil 21 and current detecting resistor 26. The formula for the resonant frequency f0 of the ion current path is $$f0=1/(2\pi\sqrt{(LC)})$$

where L is the inductance of the secondary winding 21*b* and C is the capacitance of the entire ion current path. For example, when L=5H, C=50 pF, the resonant frequency f0 is approximately 10 kHz. In this case, square wave signals are produces by the oscillator 25 with the frequency close to the resonant frequency f0 of the ion current path.

Moreover, the total resistance R of the ion current path is set so that the sharpness Q of resonance expressed by the following equation is larger than 1.

$$Q=\sqrt{(L/C)}/R$$

Figure 3:
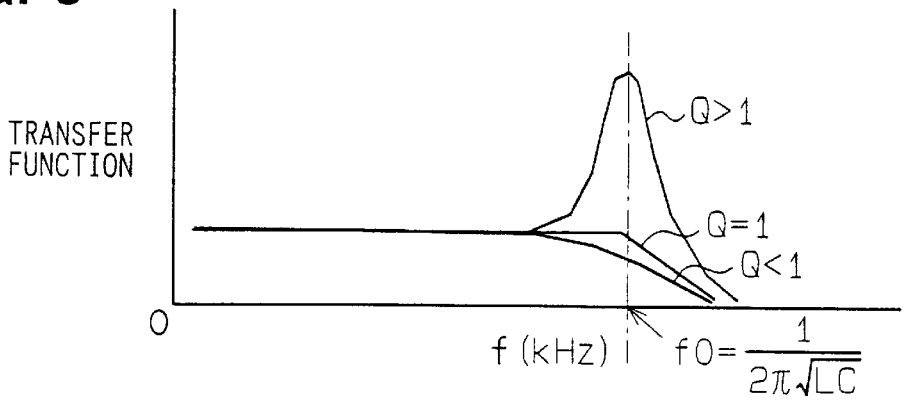
FIG. 3 is a frequency characteristic diagram regarding a transfer function of an ion current path in the first embodiment.

Referring to FIG. 3, the amount of current flow varies in response to the sharpness Q of resonance. By setting Q larger than 1, a larger amount of ion current flows at the resonant frequency f0. Therefore, the level of the ion current increases.

Figure 4:
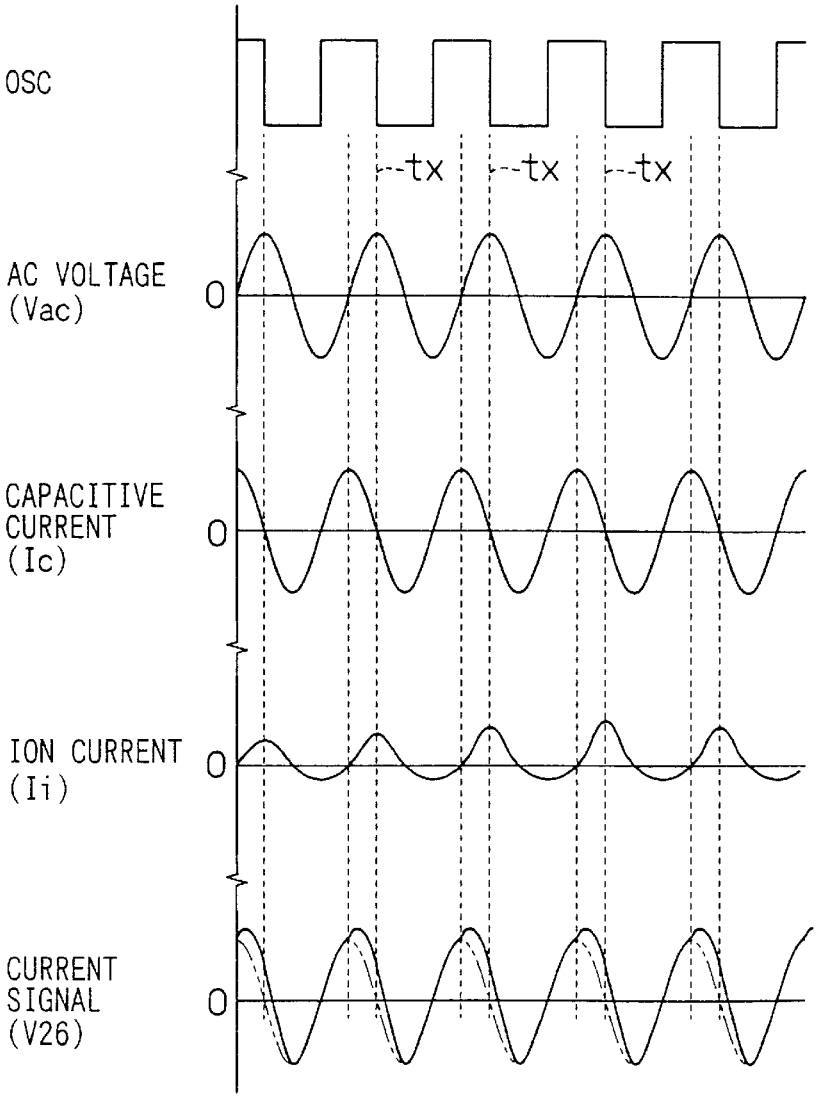
FIG. 4 is a time chart regarding an ion current detecting operation in the first embodiment.

The waveform (a) of FIG. 4 expresses a square wave signal OSC generated by the oscillator 25. The waveform (b) expresses an AC voltage (Vac) applied between the opposing electrodes 11 and 12. A high AC voltage having the same frequency as that of the square wave signal is generated in the secondary winding 21*b* and applied between the opposing electrodes 11 and 12. The waveform of Vac is more blunt and approximately 90° out of phase compared with the square wave signal. This results from stray capacitances that exist in the condition that the transistor 23 and ignition coil 21 are installed.

The waveform (c) of FIG. 4 expresses a capacitive current (Ic) flowing through the capacitive component of the spark plug 10 or ignition coil 21 when Vac is applied. Ic is proportional to Vac differentiation with respect to time, and univocally defined by the electrical constant of the circuit containing the spark plug 10 and ignition coil 21. The waveform (d) of FIG. 4 expresses a combustion ion current (Ii) which varies in response to variations in the amount of combustion ions. The amplitude of Ii is proportional to the amount of combustion ions between the opposing electrodes 11 and 12. Ii varies in phase with Vac.

The sum of Ic and Ii is a total amount of current flowing between the opposing electrodes 11 and 12. The waveform (e) of FIG. 4 expresses a current detection voltage V26, which represents current signal. The waveform of the detection voltage V26 varies depending on the condition, combustion or misfire. The solid line waveform shows the voltage in the combustion condition while the broken line waveform shows the signal in the misfire condition. The detection voltages V26 are inputted to the sample-hold circuit 27.

At the time tx when the square wave signal shifts from the H-level to the L-level, the capacitive current becomes nearly 0 since the AC voltage becomes maximum. On the other hand, the combustion ion current becomes maximum. At this timing tx, the detection voltage V26 is held in the sample-hold circuit 27 and the condition, combustion or misfire, is determined based on the detection voltage V26. The detection voltage V26 held in the sample-hold circuit 27 has only an ion current component excluding a capacitive current component. The combustion condition is properly determined based on the signal level. When combustion ions are not generated due to misfire, the detection voltage V26 becomes nearly 0. As a result, occurrence of misfire is properly determined.

According to this embodiment, the following advantages can be obtained. Since the frequency of the AC voltage generated by the oscillator 25 is set close to the resonant frequency of the ion current path, a larger amount of ion current flows. As a result, the accuracy of ion current detection is improved and the combustion condition is properly determined. Even higher level of ion detection voltages can be obtained by setting the total resistance R of the ion current path so that the sharpness Q of resonance becomes larger than 1.

The detection voltage V26 is held in the sample-hold circuit 27 at the phase where the AC voltage becomes maximum. Then, the combustion condition of the internal combustion engine is detected based on the detection voltage V26. In this method, only combustion ion current can be extracted from the current detected by the current detecting resistor 26. Therefore, the combustion condition is properly determined.

[Second Embodiment]

The ion current detecting device in this embodiment is configured so that the frequency of the AC voltage can be variably set in response to the variation of the resonant frequency f0. This is because, in the first embodiment, the frequency of the AC voltage is fixed so that it matches with the resonant frequency f0 of the ion current path. Here, the AC voltage is a power source for ion current detection. However, the resonant frequency f0 varies in response to variation in capacitance caused by dust on wires of the ion current path.

Figure 5:
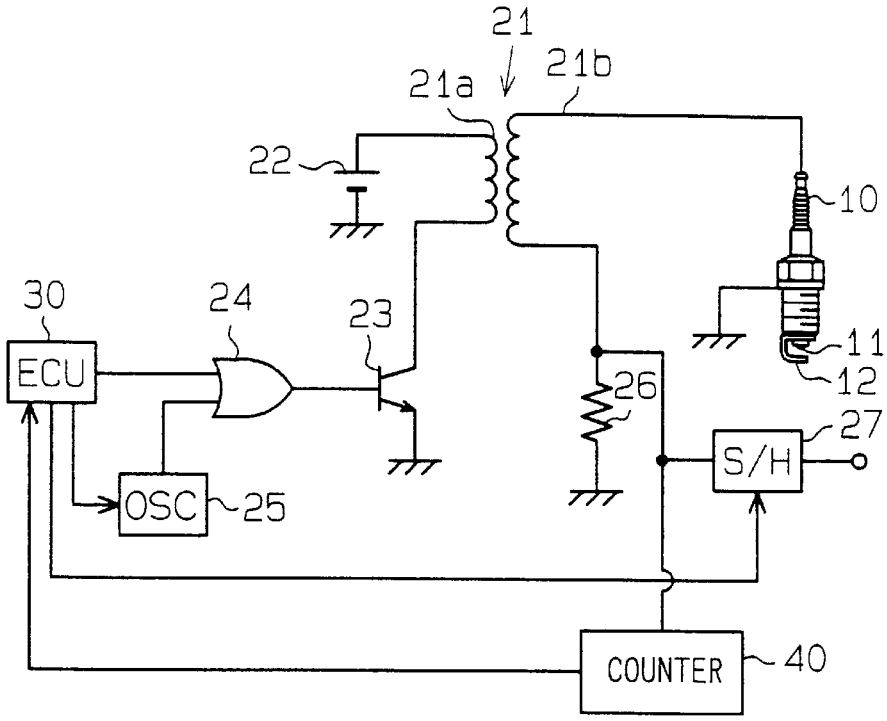
FIG. 5 is a schematic diagram showing an ion current detecting device for an internal combustion engine according to the second embodiment of the present invention.

Referring to FIG. 5, a frequency counter 40, which is a conventional frequency measurement device, is added. The frequency counter 40 takes a voltage detected by the current detecting resistor 26 and measures a frequency of current (current frequency f1) flowing through the ion current path.

The results determined by the frequency counter 40 is inputted to the ECU 30. The ECU 30 variably sets the frequency of the oscillator 25 based on the results of the frequency counter 40.

Referring to FIG. 2, a direct current (frequency=0) flows through the ion current path during the discharge period (t2 to t3) that starts immediately after the ignition timing t2. On the other hand, an AC current with a free vibrating frequency, namely, a resonant frequency f0 flows through the ion current path after the discharge is completed (t3). This is due to the residual magnetism in the ignition coil 21.

In this case, the discharge completion timing can be determined as the current flowing through the ion current path starts oscillating. A current frequency f1 measured by the frequency counter 40 after the completion of discharge is determined as a resonant frequency f0 of the ion current path. A square wave signal with the same frequency as the resonant frequency f0 (=f1 at the time of discharge completion) is outputted by the oscillator 25 after time t3. The AC voltage with the same frequency as the resonant frequency f0 is applied to the spark plug 10. As a result, the ion current is accurately detected.

Figure 6:
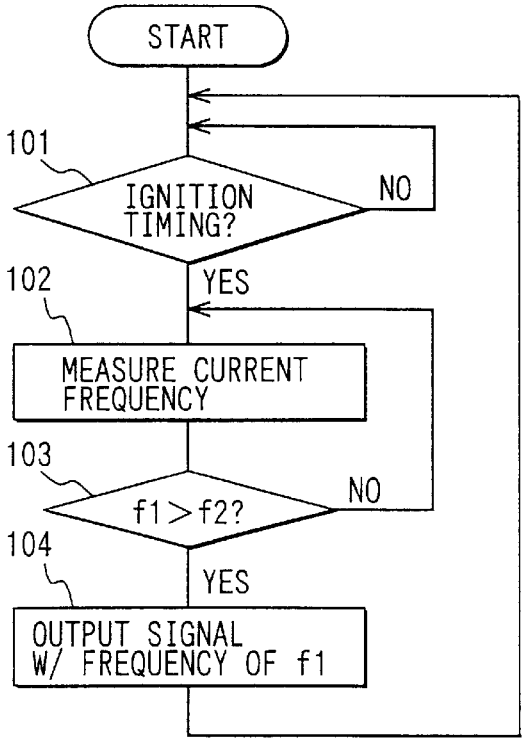
FIG. 6 is a flowchart showing steps to set a frequency of an AC voltage in the second embodiment.

Referring to the flowchart of FIG. 6, whether it is ignition timing of the combustion cylinder in use is determined at step 101. If it is the ignition timing, the process proceeds to step 102. At step 102, the current frequency f1 in the ion current path is measured by the frequency counter 40 and the result of the measurement is inputted to the ECU 30.

At step 103, whether or not the detected current frequency f1 exceeds a predetermined frequency f2 is determined. If the current frequency f1 has exceeded the frequency f2, the process proceeds to step 104. If the result of step 103 is YES, a completion of discharge is determined. At step 104, the current frequency f1 at that time is determined as the resonant frequency f0 of the ion current path. The frequency signal with the same frequency as the current frequency f1 (=f0) is outputted from the oscillator 25.

According to the second embodiment, the frequency of the AC voltage is variably set by the oscillator 25 based on the frequency of the current in the ion current path (measured frequency). Therefore, even when the resonant frequency f0 of the ion current path varies due to disturbances, the frequency of the AC voltage can always be set close to the resonant frequency f0.

When the current flowing through the ion current path starts oscillating after the ignition, application of the AC voltage is started. Then, the ion current is detected. Therefore, an influence by an ignition noise can be reduced.

[Third Embodiment]

In this embodiment, knock detection is performed based on a reading of an ion current measurement. When performing a knock detection in an internal combustion engine, detection of a signal component a little less than 10 kHz (e.g., 7 kHz) corresponding to a knock frequency is required. When detecting a knock, the frequency of the AC voltage generated by the oscillator 25 is desirable to be set twice higher than the knock frequency. In such a case, to match the frequency of the AC voltage with the resonant frequency of the ion current path (secondary winding of the ignition coil), the inductance of the secondary winding 21*b* needs to be reduced. This may cause a reduction in ignition energy. In this embodiment, therefore, an ion current detecting device for detecting an ion current with high sensitivity is provided in order to improve the accuracy of the knock detection.

Figure 10A:
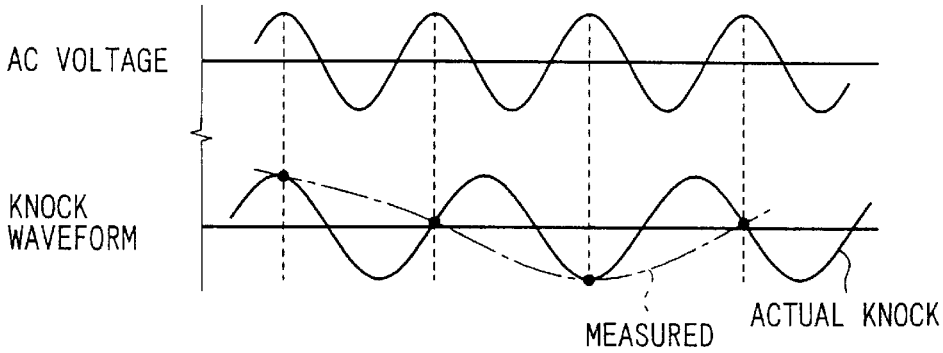
FIGS. 10A and 10B are a time charts showing an AC voltage and a knock waveform in the third embodiment.
Figure 10B:
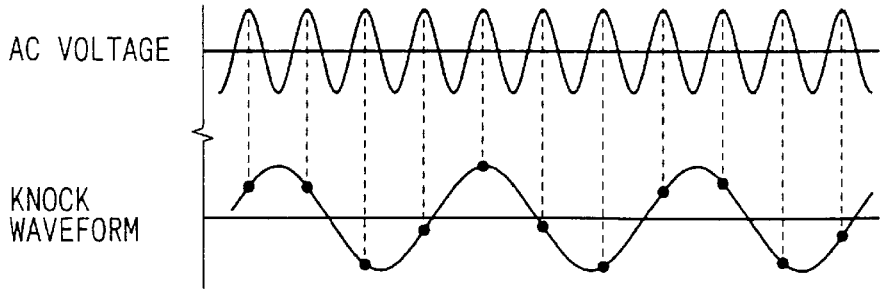

By setting up the frequency of the AC voltage twice higher than the knock frequency and measuring the ion current in response to the period of the AC voltage, an actual knock waveform can be accurately reproduced. In other words, the device in this embodiment has a configuration to measure the ion current in response to the period of the AC voltage. If the frequency of the AC voltage is nearly equal to the knock frequency, as shown in FIG. 10A, a knock signal waveform of a measurement result differs from an actual knock signal waveform. On the other hand, if the frequency of the AC voltage is sufficiently higher than the knock frequency, a knock signal waveform similar to the actual waveform can be produced.

Figure 7:
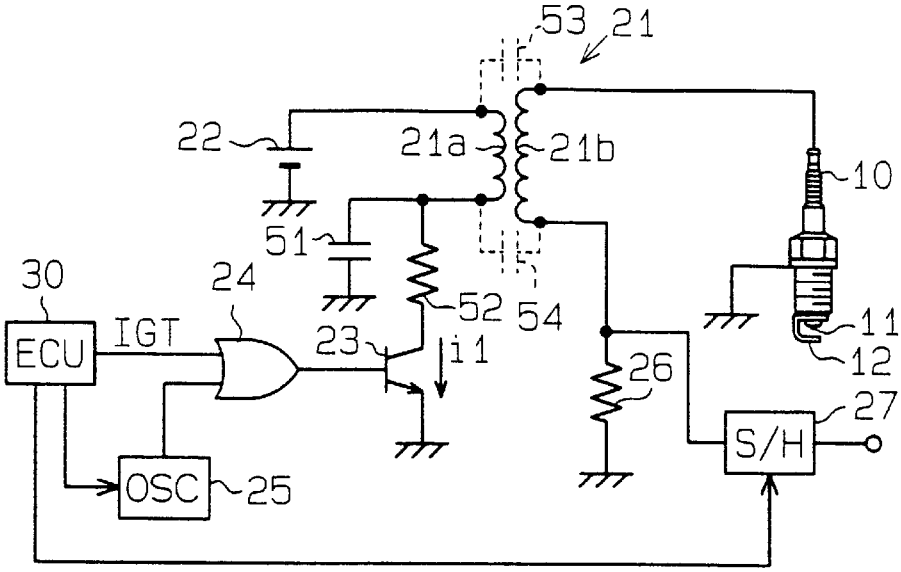
FIG. 7 is a schematic diagram showing an ion current detecting device for an internal combustion engine according to the third embodiment of the present invention.

Referring to FIG. 7, a capacitor 51 is connected in series with the primary winding 21*a* of the ignition coil 21 in addition to the configuration shown in FIG. 1. Moreover, a voltage adjusting resistor 52 is connected between the primary winding 21*a* and the transistor 23.

The capacitor 51 is provided to adjust the resonant frequency of the primary winding 21*a*. The formula for the resonant frequency f0 on the primary winding 21*a* side is $$f0=1/(2\pi\sqrt{(L1\cdot C)})$$

where L1 is the inductance of the primary winding 21*a* and C is the capacitance of the capacitor 51. For example, if L1 is 3 mH and C is 10 nF, the resonant frequency f0 is approximately 30 kHz. In this embodiment, the resonant frequency f0 on the primary winding 21*a* side is nearly equal to the frequency of the AC voltage generated by the oscillator 25. Therefore, square wave signals (AC voltages) with approximately same frequency as the resonant frequency f0 are produced by the oscillator 25. The inductance of the secondary winding 21*b* is 18H. This is sufficiently large in order to derive adequate ignition energy.

The resistance of the voltage adjusting resistor 52 is set so that the an amplitude of the AC voltage in the secondary winding 21*b* is smaller than a certain value. This value is the one which causes a discharge at the spark plug 10 when the frequency of the AC voltage is 30 kHz. For instance, the resistance is set to make the AC voltage smaller than 300V.

In the above configuration, the ion current is measured when the AC voltage is applied by the oscillator 25 after the discharge at the spark plug 10. The ion current flows through the spark plug 10, primary winding 21*a,* capacitive components 53 and 54 of the ignition coil 21 and current detecting resistor 26 before it is measured.

If the resonant frequency f0 on the primary winding 21*a* side is approximately 30 kHz, it is adjusted to 0.7 times higher than the knock frequency (approx. 7 kHz). Therefore, knocks are accurately detected. Referring to the frequency characteristics shown in FIG. 8, a transfer function is equal to or more than 1 in the frequency range lower than "f0×$\sqrt{2}$."Therefore, desirable gain of the ion current detection can be obtained. In other words, knocks can be detected with high accuracy by setting the knock frequency Fk equal to or smaller than f0×$\sqrt{2}$. This leads to a conclusion that f0 is equal to or more than Fk×$\sqrt{2}$ (nearly equal to 0.7×Fk).

Figure 9:
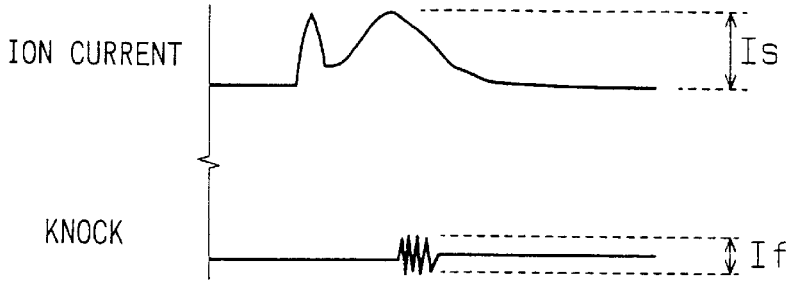
FIG. 9 is a time chart showing a raw waveform and a knock frequency component of the ion current in the third embodiment.

Referring to FIG. 9, Is is a signal level of raw waveform of the ion current while If is that of knock frequency component. The levels of those signals differ depending on conditions, whether or not the resonant frequency is adjusted by the capacitor 51. The following are the result of the comparison between those two conditions.

When the resonant frequency is not adjusted by the capacitor 51, If becomes less than Is. When the resonant frequency is adjusted by the capacitor 51, If is approximately the same level as Is. This is because the signals cannot follow the knock frequency around 7 kHz when the resonant frequency is not adjusted while they can do so when the resonant frequency is adjusted.

According to the third embodiment, a larger amount of ion current flows since the resonant frequency f0 is adjusted so that a gain of the ion current detection is within a specified range (transfer function≧1). Therefore, the level of the ion current becomes higher. This improves an accuracy of the ion current detection and provide accurate determination of combustion conditions.

Moreover, the inductance of the secondary winding 21*b* need not be reduced. As a result, an ignition energy can be ensured. The devices of the embodiments provide accurate knock detection while maintaining adequate ignition energy.

The present invention should not be limited to the embodiments previously discussed and shown in the figures, but may be implemented in various ways without departing from the spirit of the invention.

For example, the devices in the first and second embodiments can have a configuration which changes frequencies of the oscillator 25 in steps. The frequency can be changed in two or three steps based on the current frequency (measured frequency) in the ion current path or disturbance of the ignition system.

In the above embodiments, the oscillator 25 utilized as an alternating voltage applying device is on the primary side. However, it can be on the secondary side. In such a case, the accuracy of ion current detection can be still improved by approximately matching the frequency of the AC voltage produced by the AC voltage applying device with the resonant frequency of the ion current path.

Figure 8:
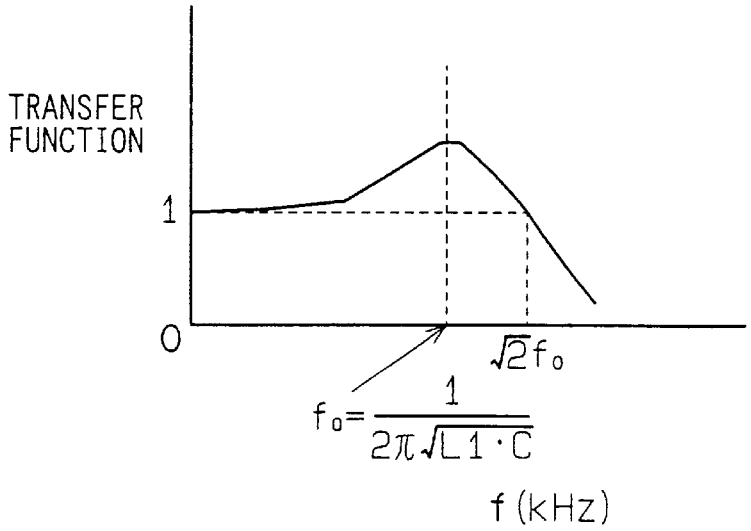
FIG. 8 is a frequency characteristic diagram regarding a transfer function for the primary side of the ignition coil in the third embodiment.

In the third embodiment, the resonant frequency f0 on the primary side is adjusted to higher than 0.7 ($1/\sqrt{2}$) times higher than the knock frequency of the internal combustion engine. Referring to FIG. 8, a detecting gain (transfer function) is attenuated in the range higher than the resonant frequency f0. A gradient of the attenuation varies depending on a resistance of the voltage adjusting resistor 52. For example, larger the resistance of the voltage adjusting resistor 52, gentler the gradient.

The gain of the ion current detection (transfer function) should not be limited to the range larger than 1. It can be expanded. Therefore, the resonant frequency f0 on the primary side can be set to n times (certain percentage) higher than the knock frequency. The value of n is preferable to be around 0.7 or larger. The accuracy of knock detection is certainly improved by adjusting the resonant frequency on the primary side in response to the knock frequency.

What is claimed is:

1. An ion current detecting device for an internal combustion engine comprising:

an ignition coil having primary and secondary windings;

a pair of opposing electrodes connected to the secondary winding of the ignition coil installed in a combustion chamber of the internal combustion engine;

an AC voltage applying means for applying an AC voltage between the opposing electrodes; and a current detecting means for detecting a current flowing between the opposing electrodes, wherein a frequency of the AC voltage applied by the AC voltage applying means is set close to a resonant frequency of an ion current path on a secondary side of the ignition coil through which the ion current flows.

2. An ion current detecting device for an internal combustion engine as in claim 1 further comprising:

a switching device connected to the primary winding of the ignition coil for causing a high voltage in the secondary winding with on/off operations; and an oscillator as the AC voltage applying means outputting repetition signals at a certain frequency, wherein the switching component is driven by the repetition signals from the oscillator after the switching component is driven by an ignition signal.

3. An ion current detecting device for an internal combustion engine as in claim 1 further comprising:

a frequency measuring means for measuring a frequency of the current in the ion current path; and a frequency modifying means for modifying a frequency of the AC voltage applied by the AC voltage applying means based on the measured frequency.

4. An ion current detecting device for an internal combustion engine as in claim 3, wherein the frequency of current flowing through the ion current path after an ignition is monitored and a resonant frequency of the ion current path is determined based on the current frequency at a point when the current starts oscillating.

5. An ion current detecting device for an internal combustion engine as in claim 4, wherein the AC voltage applying means starts applying the AC voltage at time when the current flowing in the ion current path starts oscillating after the ignition.

6. An ion current detecting device for an internal combustion engine comprising:

an ignition coil having primary and secondary windings;

a pair of opposing electrodes connected to the secondary winding of the ignition coil installed in a combustion chamber of the internal combustion engine;

an AC voltage applying means for applying an AC voltage between the opposing electrodes; and a current detecting means for detecting a current flowing between the opposing electrodes, wherein a capacitive component is connected in series to the primary winding of the ignition coil, and a resonant frequency determined by an inductance of the primary winding and capacitance of the secondary winding is adjusted so that a gain of ion current detection is within a specified range.

7. An ion current detecting device for an internal combustion engine as in claim 6, wherein the resonant frequency determined by the inductance of the primary winding and the capacitance of the secondary winding is set to a value a certain percent higher than a knock frequency which is specific to each engine.

8. An ion current detecting device for an internal combustion engine as in claim 6, wherein the resonant frequency determined by the inductance of the primary winding and the capacitance of the secondary winding is set to a value 0.7 times higher than the knock frequency which is specific to each engine.

9. An ion current detecting device for an internal combustion engine as in claim 6, wherein:

the current detecting means detects the ion current at a cycle of the AC voltage application by the AC voltage applying means; and the AC voltage applying means applies the AC voltage at a frequency set to a value at least twice higher than the knock frequency which is specific to each engine.

10. An ion current detecting device for an internal combustion engine as in claim 6, wherein the resonant frequency determined by the inductance of the primary winding and the capacitance of the secondary winding is set to the frequency of the AC voltage applied by the AC voltage applying means.

11. An ion current detecting device for an internal combustion engine as in claim 6 further comprising:

a switching means connected to the primary winding of the ignition coil causing a high voltage in the secondary winding with on/off operations; and an oscillator as the AC voltage applying means generating repetition signals at a certain frequency, wherein the switching component is driven by the repetition signals from the oscillator after the switching component is driven by an ignition signal.

* * * * *